US009057982B2

(12) United States Patent
Okabe

(10) Patent No.: US 9,057,982 B2
(45) Date of Patent: Jun. 16, 2015

(54) DEVELOPER CONTAINER

(71) Applicant: Yasushi Okabe, Nagoya (JP)

(72) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/039,649

(22) Filed: Sep. 27, 2013

(65) Prior Publication Data

US 2014/0086640 A1 Mar. 27, 2014

(30) Foreign Application Priority Data

Sep. 27, 2012 (JP) ..... 2012-214473

(51) Int. Cl.
*G03G 15/08* (2006.01)

(52) U.S. Cl.
CPC ..... *G03G 15/0865* (2013.01); *G03G 15/0875* (2013.01); *G03G 2215/0802* (2013.01)

(58) Field of Classification Search
CPC ..... G03G 2215/0802
USPC ..... 399/254, 256, 263
See application file for complete search history.

(56) References Cited

U.S. PATENT DOCUMENTS

| | | | | |
|---|---|---|---|---|
| 5,940,658 | A | 8/1999 | Yokoi et al. | |
| 7,362,986 | B2 | 4/2008 | Okabe et al. | |
| 8,219,008 | B2 * | 7/2012 | Tanaka | 399/254 |
| 2006/0093399 | A1 | 5/2006 | Okabe et al. | |
| 2008/0138108 | A1 | 6/2008 | Okabe et al. | |

FOREIGN PATENT DOCUMENTS

| | | | |
|---|---|---|---|
| JP | H01-250974 | A | 10/1989 |
| JP | H07-28317 | A | 1/1995 |
| JP | 09-222783 | * | 8/1997 |
| JP | H10-339995 | A | 12/1998 |
| JP | 3689552 | B2 | 8/2005 |
| JP | 2006-154744 | A | 6/2006 |

* cited by examiner

*Primary Examiner* — Sandra Brase
(74) *Attorney, Agent, or Firm* — Banner & Witcoff, Ltd.

(57) ABSTRACT

A developer container including: a housing including an inner surface that defines a filling port for filling developer; a cap mounted to the housing and sealing the filling port; and an agitating member having a rotary shaft and configured to be rotated about the rotary shaft to agitate the developer in the housing, wherein a first end portion of the rotary shaft is supported by the inner surface of the housing and the cap mounted to the housing.

20 Claims, 14 Drawing Sheets

DEVELOPER CONTAINER

CROSS-REFERENCE TO RELATED APPLICATIONS

This application claims priority from Japanese Patent Application No. 2012-214473 filed on Sep. 27, 2012, the entire contents of which are incorporated herein by reference.

TECHNICAL FIELD

Aspects of the invention relate to a developer container including a cap that is provided to seal a filling port for filling developer into a housing and an agitating member for agitating the developer in the housing.

BACKGROUND

In general, in an image forming apparatus of an electrophotographic type, an agitating member is provided to a developer container that contains therein developer to be used for image formation. A latent image on a photosensitive member is developed by agitating the developer and supplying the developer to a photosensitive member.

The developer container is typically configured by a container body and a cover member closing the container body. When assembling the developer container, before attaching the cover member, a shaft (rotary shaft) of the agitating member is mounted while being bent to an agitating member support part, which is provided to a part of a sidewall of the container body at which a filling port is not formed, through an opening of the container body.

In the meantime, a configuration has been also known in which spoke-shaped ribs, which substantially equally divide an opening of the filling port for filling the developer, are provided and a bearing for supporting one end portion of the agitating member is arranged at a connection part between the ribs. The bearing is arranged so as to overlap the filling port when seen from a longitudinal direction of the developer container.

SUMMARY

When assembling the developer container, the process of mounting the agitating member while bending the shaft thereof is complex and inefficient and becomes an obstacle to reduction of the assembling time.

Also, according to the configuration where the agitating member support part overlaps the filling port when seen from the longitudinal direction of the developer container, the bearing of the agitating member, the ribs crossing the filling port so as to support the bearing and the like obstruct the filling of the developer. Thereby, the filling time becomes unnecessarily longer.

Accordingly, aspects of the invention provide a developer container in which an agitating member can be easily mounted and in which a filling efficiency of developer is not lowered due to narrowing of a filling port area.

According to an aspect of the invention, there is provided a developer container including: a housing including an inner surface that defines a filling port for filling developer; a cap mounted to the housing and sealing the filling port; and an agitating member having a rotary shaft and configured to be rotated about the rotary shaft to agitate the developer in the housing, wherein a first end portion of the rotary shaft is supported by the inner surface of the housing and the cap mounted to the housing.

Accordingly, it is possible to implement a configuration enabling the agitating member to be easily mounted while not lowering the filling efficiency of the developer.

BRIEF DESCRIPTION OF DRAWINGS

FIGS. 2A, 2B, 2C and 2D are views showing an end portion at a toner filling port-side of a developing cartridge according to a first illustrative embodiment, in which FIG. 2A is a side view. FIG. 2B is a sectional view of the end portion seen from an inner side, FIG. 2C is a sectional view taken along a line A-A of FIG. 2B, showing a part of a housing to which a shaft (a rotary shaft) of an agitator, which is an example of the agitating member, is supported and FIG. 2D illustrates a temporary fixation structure that is provided to an edge portion of a recess part formed at the toner filling port;

FIGS. 4A, 4B and 4C are views showing a structure for positioning the agitator in the longitudinal direction, in which FIG. 4A is an overall view of the agitator according to the first illustrative embodiment, FIG. 4B shows another example (a modified embodiment) of a structure for positioning one end portion of the agitator according to the first illustrative embodiment and FIG. 4C is a sectional view showing a state where the agitator of a modified embodiment is mounted to the housing;

FIGS. 5A, 5B, 5C and 5D are views showing an end portion at a toner filling port-side of a developing cartridge according to a second illustrative embodiment, in which FIG. 5A is a sectional view of the end portion seen from an inner side, FIG. 5B is a sectional view taken along a line B-B of FIG. 5A, showing a part of a housing to which a shaft of an agitator is supported, FIG. 5C shows a fitting structure for positioning upon mounting of a cap and FIG. 5D is a sectional view showing a modified embodiment of a structure for positioning an end portion of the agitator;

FIGS. 6A, 6B and 6C are views showing an end portion at a toner filling port-side of a developing cartridge according to a third illustrative embodiment, in which FIG. 6A is a sectional view of the end portion seen from an inner side, FIG. 6B is a sectional view taken along a line C-C of FIG. 6A, showing a part of a housing to which a shaft of an agitator is supported and FIG. 6C is a sectional view showing a modified embodiment of a structure for positioning an end portion of the agitator; and FIGS. 7A, 7B, 7C and 7D are views showing an end portion at a toner filling port-side of a developing cartridge according to a fourth illustrative embodiment, in which FIG. 7A is a sectional view of the end portion seen from an inner side, FIG. 7B is a sectional view taken along a line D-D of FIG. 7A, showing a part of a housing to which a shaft of an agitator is supported and FIGS. 7C and 7D show modified embodiments of a structure for positioning an end portion of the agitator.

DETAILED DESCRIPTION

Hereinafter, various illustrative embodiments of the invention will be specifically described with reference to the drawings. Meanwhile, in the following descriptions, an overall configuration of a color printer 1 (an image forming apparatus) to which a developing cartridge 100 of an illustrative embodiment is mounted will be briefly described and then a detailed configuration around a toner filling port of the developing cartridge 100 will be described.

Figure 1:
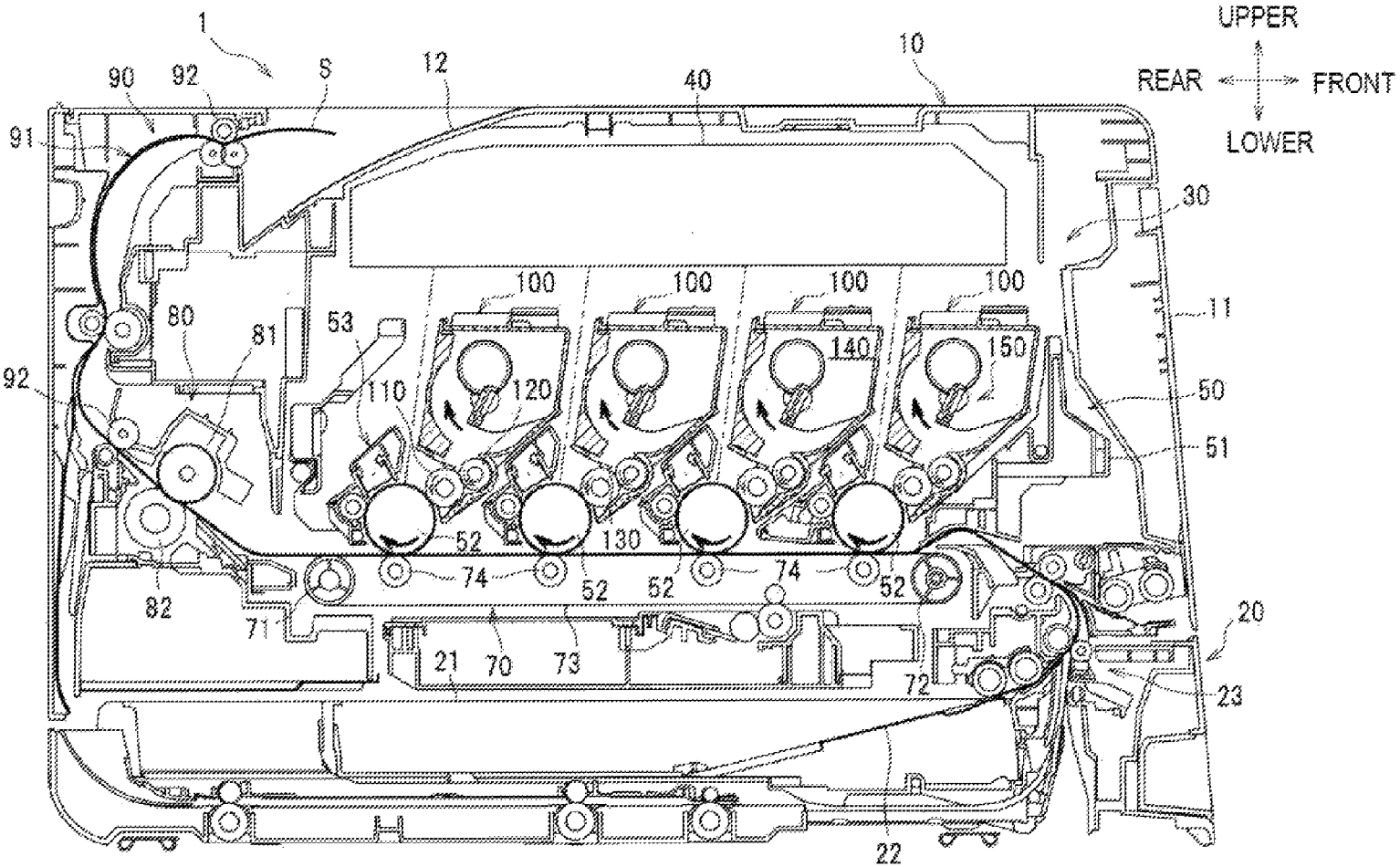
FIG. 1 is a sectional view showing an overall configuration of a color printer to which a developing cartridge, which is an example of the developer container, is mounted.

Also, in the following descriptions, the directions are described on the basis of a user who uses the color printer 1. That is, the right side of FIG. 1 is referred to as the 'front' side, the left side is referred to as the 'rear' side, the front side is referred to as the 'left' side and the back side is referred to as the 'right' side. Also, the upper and lower sides in FIG. 1 are referred to as the 'upper' and 'lower' sides.

<Overall Configuration of Color Printer>

As shown in FIG. 1, the color printer 1 has, in a body case 10 that is an example of the image forming apparatus body, a feeder unit 20 that feeds a sheet S (a recording sheet), an image forming unit 30 that forms an image on the fed sheet S and a sheet discharge unit 90 that discharges the sheet S having an image formed thereon.

The feeder unit 20 is provided at a lower part in the body case 10 and mainly has a sheet feeding tray 21, a sheet pressing plate 22 and a sheet feeding mechanism 23. The sheet S accommodated in the sheet feeding tray 21 is inclined upwards by the sheet pressing plate 22 and is fed towards the image forming unit 30 by the sheet feeding mechanism 23.

The image forming unit 30 mainly has an exposure device 40, a photosensitive unit 50, four developing cartridges 100, a transfer unit 70 and a fixing unit 80.

The exposure device 40 is provided at an upper part in the body case 10 and has a laser light source, a polygon mirror, a plurality of lenses, a plurality of reflecting mirrors and the like, which are not shown. The laser light that is emitted from the laser light source on the basis of image data is reflected on the polygon mirror and the reflecting mirrors, passes through the lenses and is then high-speed scanned on surfaces of respective photosensitive drums 52 (see the dashed line).

The photosensitive unit 50 is arranged between the sheet feeding tray 21 and the exposure device 40 and mainly has a substantially box-shaped drawer 51 having an open upper part, four photosensitive drums 52 that are arranged in parallel in the front-rear direction and four charges 53 that are provided in correspondence to the respective photosensitive drums 52. The drawer 51 is configured so that it can be attached and detached (withdrawn) to and from the body case 10 in the front-rear direction by opening a front cover 11 provided to a front side of the body case 10.

The developing cartridges 100 are arranged in a line in the front-rear direction in the drawer 51. The developing cartridge 100 can be detachably mounted to the drawer 51 and can be detachably mounted to the body case 10 with being mounted to the drawer 51. The developing cartridge 100 mainly has a developing roller 110, a supply roller 120, a layer thickness regulation blade 130, a toner containing unit 140 containing therein toner that is an example of the developer and an agitator 150 that is an agitating member agitating the toner in the toner containing unit 140. A detailed configuration of the developing cartridge 100 will be described later.

The transfer unit 70 is provided between the sheet feeding tray 21 and the photosensitive unit 50 and mainly has a driving roller 71, a driven roller 72, an endless conveyance belt 73 that is provided in a tensioned state between the driving roller 71 and the driven roller 72 and four transfer rollers 74. The conveyance belt 73 has an outer surface that is arranged to abut on the respective photosensitive drums 52, and the transfer rollers 74 are arranged at an inside of the belt to sandwich the conveyance belt 73 with the respective photosensitive drums 52.

The fixing unit 80 is provided at the rear of the photosensitive unit 50 and mainly has a heating roller 81 and a pressing roller 82 that is arranged to face the heating roller 81 and presses the heating roller 81.

In the image forming unit 30, a surface of the photosensitive drum 52 is uniformly charged by the charger 53 and is then exposed by the laser light emitted from the exposure device 40, so that an electrostatic latent image based on image data is formed on the photosensitive drum 52. Also, the toner in the toner containing unit 140 is supplied to the developing roller 110 through the supply roller 120, is introduced between the developing roller 110 and the layer thickness regulation blade 130 and is then carried on the developing roller 110 as a thin layer having a predetermined thickness.

Then, the toner carried on the developing roller 110 is supplied to the photosensitive drum 52, so that the electrostatic latent image becomes visible and a toner image is formed on the photosensitive drum 52. After that, the sheet S fed from the feeder unit 20 is conveyed through between the photosensitive drums 52 and the conveyance belt 73 (the transfer rollers 74), so that the toner images formed on the respective photosensitive drums 52 are sequentially transferred with being overlapped onto the sheet S. The sheet S having the toner images transferred thereto is conveyed through between the heating roller 81 and the pressing roller 82, so that the toner images are heat-fixed.

The sheet discharge unit 90 mainly has a sheet discharge path 91 for guiding the sheet S delivered from the fixing unit 80 and a plurality of conveying rollers 92 for conveying the sheet S. The sheet S having the toner images heat-fixed thereon is conveyed through the sheet discharge path 91 by the conveying rollers 92, is discharged to an outside of the body case 10 and is then placed on a sheet discharge tray 12.

Detailed Configuration of Developing Cartridge

1. First Illustrative Embodiment

The developing cartridge 100 according to a first illustrative embodiment, particularly a structure around a filling port for filling toner is specifically described with reference to FIG. 2.

Meanwhile, in FIG. 2 and the figures after FIG. 2, the developing roller 110, the supply roller 120, the layer thickness regulation blade 130 and the like of the developing cartridge 100 are not shown.

Figure 2A:
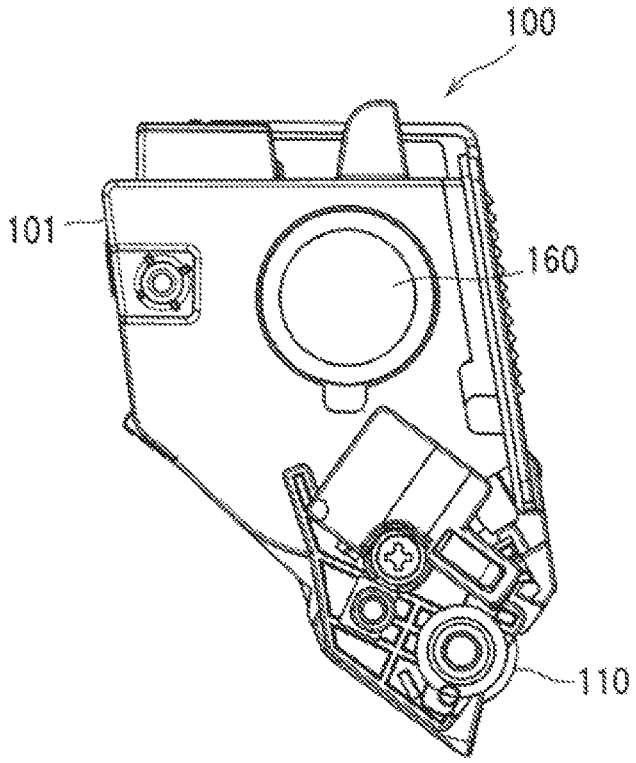
Figure 2B:
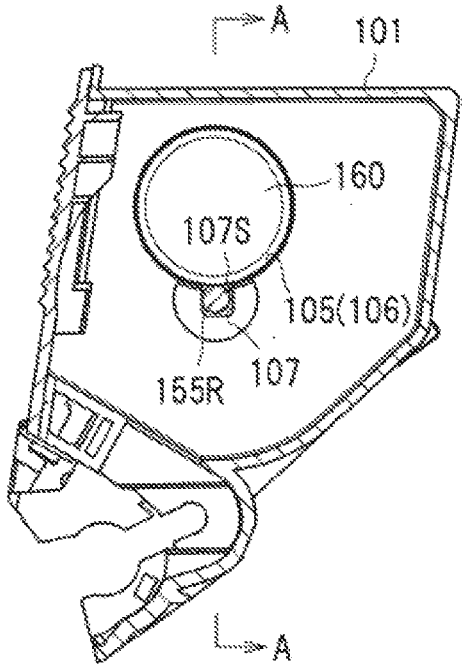
Figure 2C:
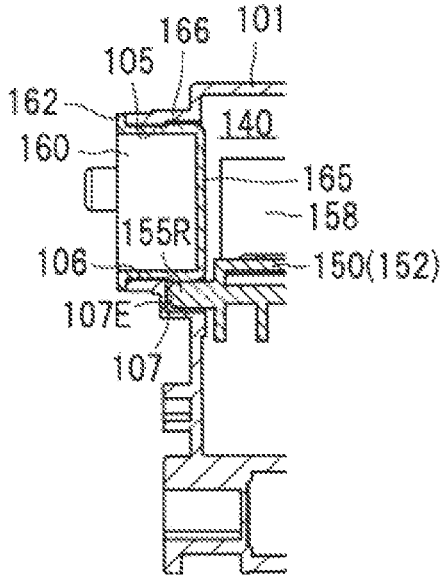

As shown in FIGS. 2A to 2C, a right end portion of the developing cartridge 100 is formed with a cylindrical opening (a toner filling port 105) for filling toner. The toner filling port 105 is formed on a wall defining the toner containing unit 140 of a cartridge frame 101 that is an example of the housing. A part of an inner periphery surface (tube part) 106 defining the toner filling port 105 is recessed outwards in a radial direction of the inner periphery surface, thereby forming a recess part 107. The inner periphery surface is a substantially cylindrical surface.

The recess part 107 extends outwards from an inner side (a toner containing part-side) edge of an inner periphery surface 106 to a vicinity of a center of the inner periphery surface 106 at a position below the toner filling port 105. An outer end portion of the recess part 107 is defined with a plane (recess termination surface 107E) extending in the upper-lower direction in FIG. 2.

The toner filling port 105 is mounted with a cap 160 closing the toner filling port 105 so that the toner filled in the toner containing unit 140 does not leak. The cap 160 is a seal member having a cap bottom part 165 having a substantially disc shape that matches with an opening shape of the toner filling port 105 and a cap tube part 166 that is closely fitted to the tube part 106 of the toner filling port 105. A flange part 162 that protrudes outwards in the radial direction is provided on an outer edge part of the cap tube part 166 (see FIG. 3D).

One end portion 155R of the shaft (the rotary shaft) 155 of the agitator 150 is inserted into the recess part 107 and the cap tube part 166 is fitted to the tubular inner periphery surface (the tube part 106) of the recess part so as to seal the toner filling port 105, so that the one end portion 155R of the shaft 155 of the agitator 150 is supported by the recess part 107 and the outer periphery surface of the cap tube part 166 of the cap 160.

A round (protruding substantially spherically) end portion of the one end portion 155R of the shaft 155 abuts on the recess termination surface 107E that is an abutting surface facing inwards in a rotary shaft center direction of the recess part 107, so that the agitator 150 is positioned in the rotary shaft direction.

Figure 2D:
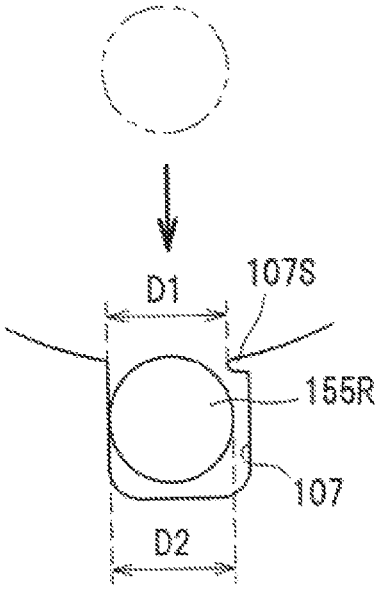

As shown in FIG. 2B, one of edge portions defining a boundary between the tube part 106 and the recess part 107 of the toner filling port 105 is provided with a projection 107S protruding towards the other edge portion. Therefore, a distance D1 between the edge portions of the recess part 107 is narrower than a width of the recess inside. Specifically, as shown in FIG. 2D, the distance D1 is slightly smaller than an outer diameter D2 of the one end portion 155R of the shaft 155 of the agitator 150 inserted into the recess part 107 (D1<D2).

Figure 3A:
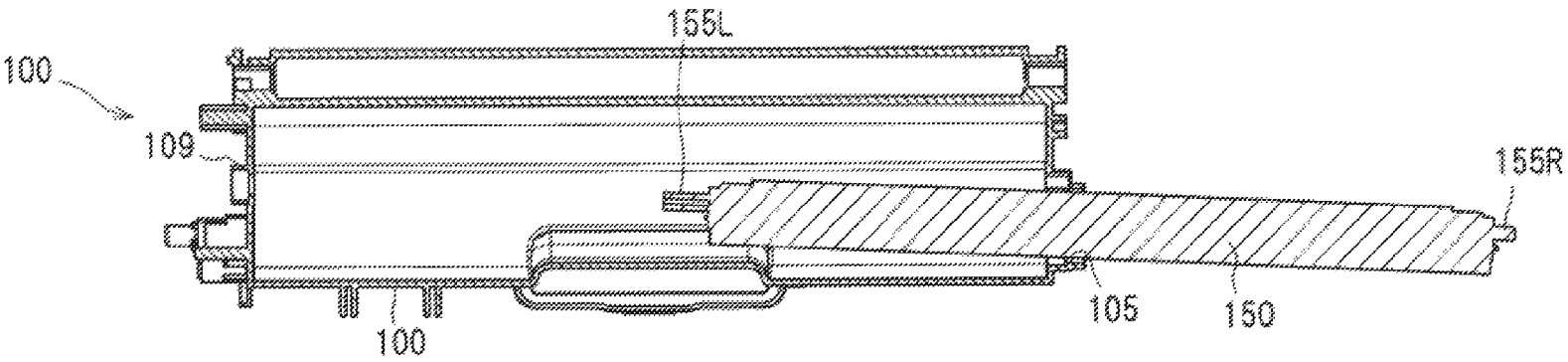
FIGS. 3A, 3B and 3C are longitudinal sectional views showing a process of mounting the agitator to the housing of the developing cartridge according to the first illustrative embodiment
Figure 3B:
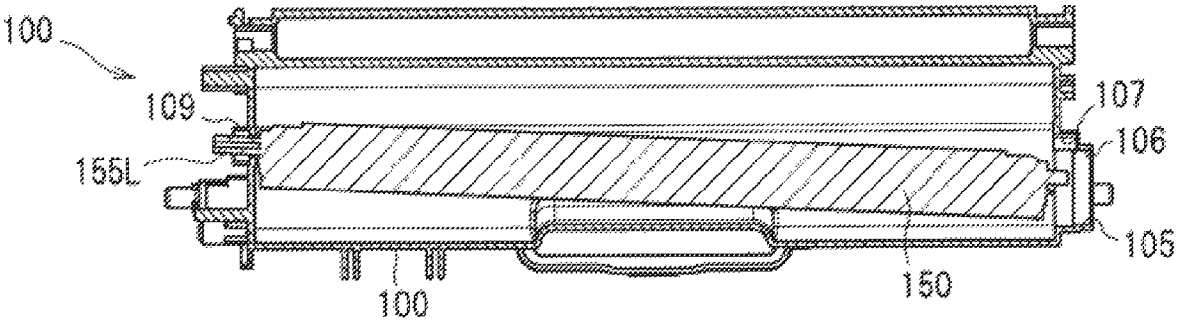
Figure 3C:
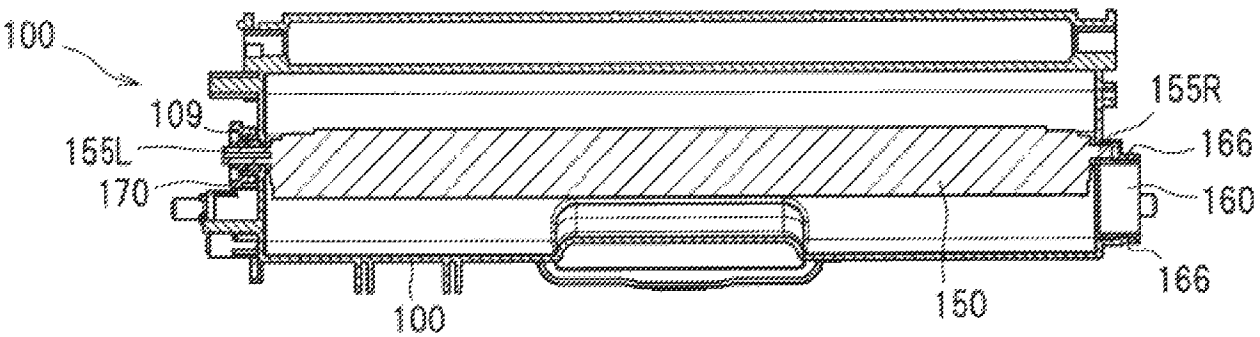

One aspect of a method (mounting process) of mounting the agitator 150 is described with reference to FIG. 3. As shown in FIG. 4A, the agitator 150 has a support part 152 that protrudes outwards from the shaft 155 in the radial direction of the shaft and a film 158 that is supported to the support part 152. The film 158 of the agitator 150 slides while being pressure-contacted on an inner wall of the toner containing unit 140. Also, as shown in FIG. 3A, the agitator 150 is configured so that a maximum size (a size in the radial direction) of the support part 152 supporting the film 158 in a direction orthogonal to the rotary shaft center is smaller than a size of the opening of the toner filling port 105 in the radial direction. Therefore, the agitator can be inserted and mounted through the toner filling port 105.

First, as shown in FIG. 3A, the agitator 150 is inserted into the toner filling port 105 provided on a right sidewall of the developing cartridge 100 from a left end portion 155L of the shaft 155. Then, as shown in FIG. 3B, the left end portion 155L is inserted into a bearing part 109 provided on a left sidewall of the developing cartridge 100. Also, as shown in FIG. 3C, the right end portion (one end portion) 155R of the shaft 155 of the agitator 150 is fitted to the recess part 107 through a side thereof.

Here, since the distance D1 between the edge portions of the recess part 107 is smaller than the outer diameter D2 of the right end portion 155R of the shaft 155, the right end portion 155R is lightly pushed in and snap-fitted, so that retaining (temporary fixation) is realized. After that, the toner is filled through the toner filling port 105. Finally, as shown in FIG. 3C, the cap 160 is fitted to position the right end portion 155R and to seal the toner filling port 105. In the meantime, a seal member (a reference numeral thereof is omitted) and a gear 170 are mounted between the left end portion 155L and the bearing part 109 from the outside. Like this, the left end portion 155L is shaft-supported to the bearing part 109 through the gear 170 and is sealed between the left end portion and the bearing part 109 by the seal member.

Figure 3D:
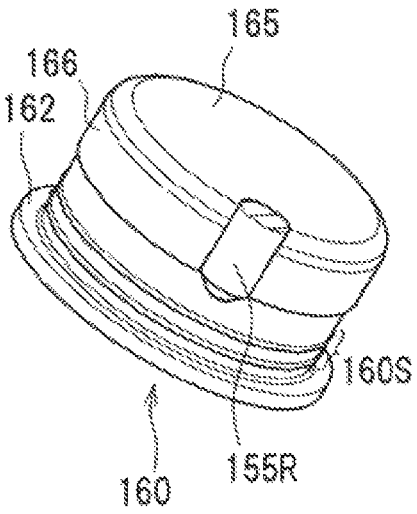
FIG. 3D is a perspective view of a cap that is mounted at a final process.
Figure 4A:
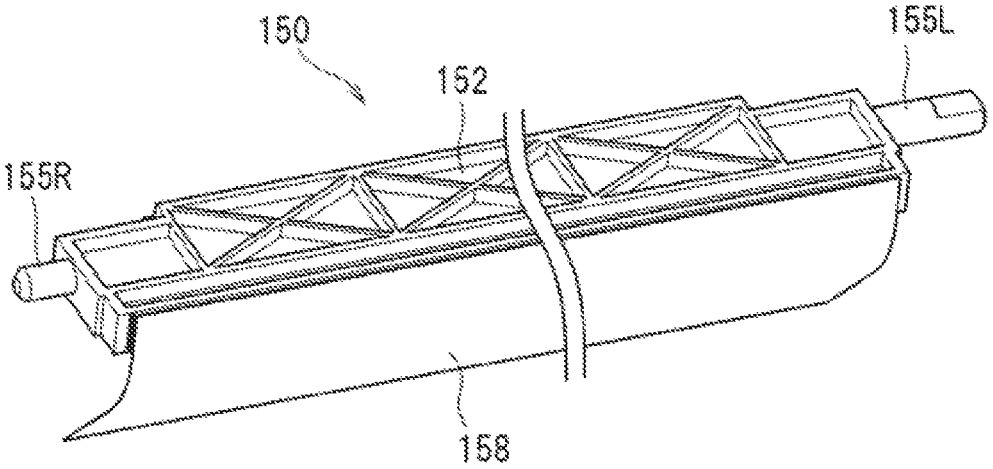

As shown in FIG. 3D, the outer periphery surface 166 of the cap 160 is formed with a seal part 160S that, when the cap is mounted to the toner filling port 105 of the cartridge frame 101, is closely contacted to the inner periphery surface (the tube part 106) of the toner filling port and thus prevents the toner from leaking. In this illustrative embodiment, the seal part 160S has ridge-shaped projections of two lines going round the outer periphery surface 166 to thus form a closed ring shape. When the cap 160 is fitted to the toner filling port 105, the seal part 160S is pressure-contacted to appropriately seal the toner filling port 105.

When mounting the cap 160, the right end portion 155R of the shaft 155 is positioned at an inner side (a downstream side in the mounting direction of the cap 160) of the seal part 160S. Therefore, all structures for supporting the right end portion 155R of the shaft 155 of the agitator 150 are arranged at the inner side, so that the toner leakage can be effectively suppressed.

In the above illustrative embodiment, following effects can be realized.

The right end portion 155R of the shaft 155 (the rotary shaft) of the agitator 150 is supported by the recess part 107, which is a part of the inner periphery surface of the cartridge frame 101, and the cap 160. Thus, since the right end portion 155R can be pushed into the recess part 107 through the side of the right end portion with the cap 160 being removed, it is possible to simply mount the agitator 150 without bending the shaft 155.

Also, the cap tube part 166 on the outer periphery surface of the cap 160 is fitted to the tube part 106 on the inner periphery surface of the cartridge frame 101, so that it is possible to securely seal the toner filling port 105. Also, in this illustrative embodiment, the seal part 160S is provided at the upstream side of the cap 160 in the mounting direction, thereby more effectively suppressing the toner leakage.

The cap 160 is contacted to the right end portion 155R of the shaft 155 of the agitator 150 at the cap tube part 166 having the cylindrical outer periphery surface. Therefore, since the shaft center position of the agitator 150 is not changed by an attaching phase (a posture in the rotating direction) of the cap 160, it is not necessary to adjust the direction upon the mounting of the cap 160, so that the attachment can be simply performed.

Also, the rotary shaft of the agitator 150 is arranged in the recess part 107 that is recessed more outwards in the radial direction than (the tube part 106 of) the inner periphery surface of the toner filling port 105. Therefore, compared to a configuration of the related art where a spoke-shaped rib dividing a filling port is provided and a rotary bearing is provided at a substantial center of an opening, it is possible to secure the wider opening in the filling port because there is no rib or bearing crossing the opening of the filling port. Therefore, it is possible to realize a configuration that does not lower the filling efficiency of the toner.

One of the edge portions of the recess part 107 formed on the inner periphery surface defining the toner filling port 105 is provided with the projection 1075 protruding towards the other edge portion and the distance D1 between the edge portions of the recess part 107 is slightly smaller than the outer diameter D2 of the right end portion 155R of the shaft 155 of the agitator 150 (D1<D2). That is, when inserting the right end portion 155R of the shaft 155 into the recess part 107, the right end portion 155R of the shaft 155 is temporarily fixed just by lightly pushing the right end portion into between the edge portions (distance: D1) of the recess part 107 narrower than the outer diameter D2 of the shaft 155. Therefore, it is possible to easily perform a series of operations of pushing the right end portion 155R of the shaft 155 into the recess part 107 on the inner periphery surface of the cartridge frame 101 without bending the agitator 150 and then mounting the cap 160 onto the cartridge frame 101.

Originally, in this illustrative embodiment, the projection 107S is not necessarily provided. That is, the projection 107S may be omitted. Since the film 158 of the agitator 150 is configured to slide while being pressure-contacted on the inner wall of the toner containing unit 140, the right end portion 155R of the shaft 155 inserted into the recess part 107 can be pressed to a bottom of the recess part 107 by a reaction force applied to the film 158 from the inner wall of the toner containing unit 140. Like this, it is possible to prevent the right end portion 155R of the shaft 155 from being separated from the recess part 107 before mounting the cap 160 or after removing the cap 160.

Also, instead of the configuration where the projection 107S is provided to only one of the edge portions of the recess part 107, a projection that protrudes towards the opposite edge portion may be provided to the other edge portion. The number, shape and arrangement of the projections may be optimized so that the distance D1 between both edge portions of the recess defining the boundary of the tube part 106 and the recess part 107 becomes a size enabling the right end portion 155R (the outer diameter. D2) of the shaft 155 of the agitator 150 to be inserted and to be temporarily fixed.

Since the right end portion 155R of the shaft 155 is configured to abut on the recess termination surface 107E (an abutting surface facing inwards in the rotary shaft direction) of the recess part 107 formed on the inner periphery surface of the toner filling port 105 of the cartridge frame 101, it is possible to perform the positioning securely and easily when mounting the agitator 150.

Since the agitator 150 and the toner filling port 105 have such shapes and sizes that the agitator 150 can be inserted through the toner filling port 105 and mounted to the cartridge frame 101, the agitator 150 can be easily mounted. Also, it is not necessary to separately provide a sealable opening (or a housing structure enabling separation/mounting and the like) for mounting the agitator 150 to the cartridge frame 101, which is favorable in terms of the stiffness and sealability of the cartridge frame 101 of the developing cartridge 100, a degree of freedom in design and the manufacturing cost.

Meanwhile, in the first illustrative embodiment, the right end portion 155R of the shaft 155 is configured so that a center (a shaft center position) of the round end portion abuts on the recess termination surface 107E of the recess part 107. However, the abutting surface restraining the rightward position of the right end portion 155R of the agitator 150 may be a part other than the recess termination surface 107E.

Figure 4B:
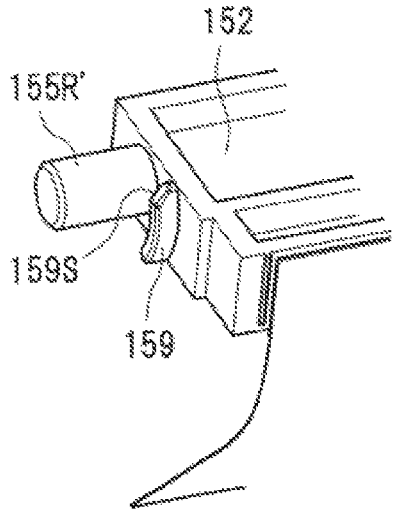
Figure 4C:
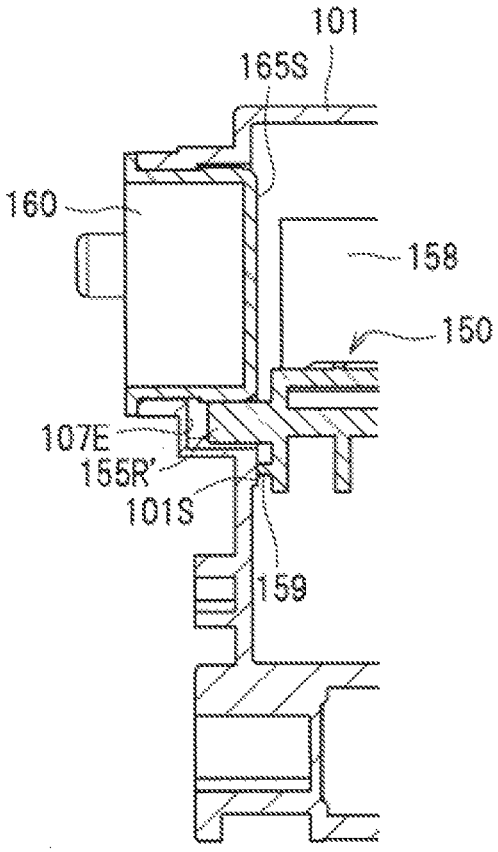

In a modified embodiment shown in FIGS. 4B and 4C, a projection 159 is provided at a position, which is distant outwards from one end portion (a right end portion) 155R' of the shaft 155 in a radial direction thereof by a predetermined interval, on a right end surface of the support part 152 of the agitator 150 and an end surface of the projection 159 abuts on an inner surface (a contact surface 101S) of the cartridge frame 101, so that the agitator 150 is positioned rightwards. A leading end of the right end portion 155R' of the shaft 155 is substantially flat and does not abut on the recess termination surface 107E.

In FIG. 4C, since the agitator 150 is arranged in a direction that the projection 159 is located below the right end portion 155R' of the shaft 155, the projection 159 abuts on the contact surface 101S of the cartridge frame 101 and is thus positioned. However, when the agitator 150 is rotated and is thus arranged in a direction that the projection 159 is located above the right end portion 155R' of the shaft 155, the projection 159 abuts on an inner surface (a contact surface 165S) of the cap bottom part 165 of the cap 160 and is thus positioned.

Also, as shown in FIG. 4B, the projection 159 is provided with an inclined surface 159S at a front end in the rotating direction of the agitator 150. Since the projection 159 is located at a position deviating outwards from the rotation axis line of the agitator 150 in the radial direction, the contact between the contact surface 101S of the cartridge frame 101 and the contact surface 165S of the cap 160 may be switched depending on the rotation of the agitator 150. Since the inclined surface 159S is provided, even when there is a step between the contact surfaces 1011S, 165S, the agitator 150 can be smoothly rotated without any catch.

2. Second Illustrative Embodiment

Subsequently, a second illustrative embodiment is specifically described with reference to FIG. 5. Meanwhile, in this illustrative embodiment, the structure for supporting the right end portion 155R, 155R' of the agitator 150 of the first illustrative embodiment is partially changed. Thus, the same constitutional elements as those of the first illustrative embodiment are denoted with the same reference numerals and the descriptions thereof are omitted.

Figure 5A:
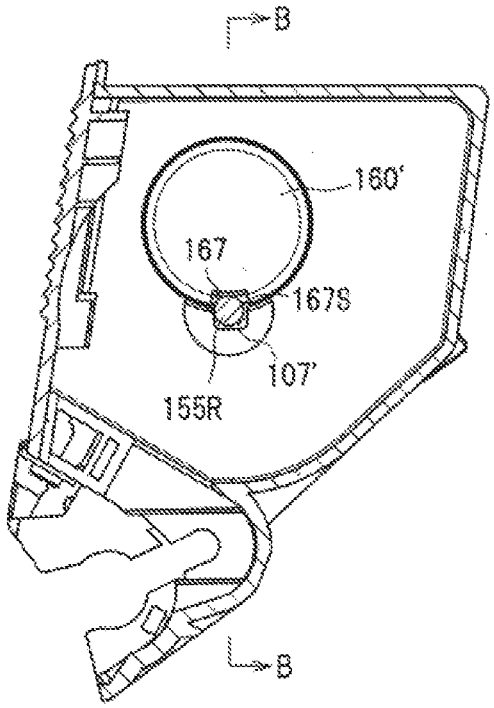
Figure 5B:
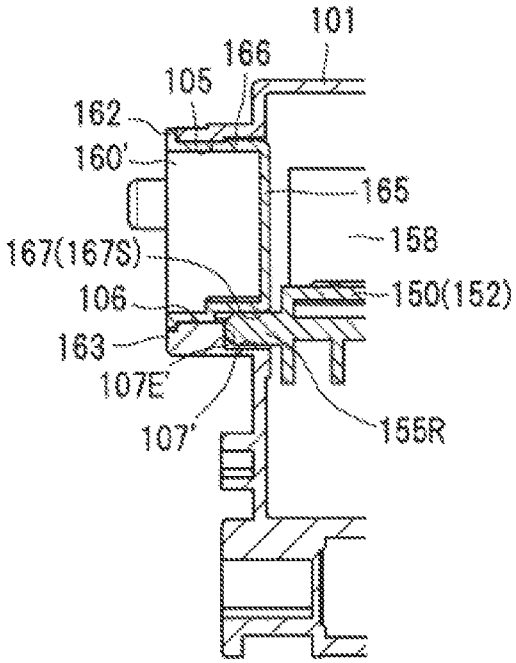

As shown in FIGS. 5A and 5B, in the second illustrative embodiment, a recess part 107' that is shallower than the recess part 107 of the first illustrative embodiment is formed on a part of the tubular inner periphery surface (tube part) 106 defining the toner filling port 105. In the meantime, a part of the outer periphery surface (cap tube part 166) of a cap 160' is formed with a cap recess part 167 that is recessed inwards in the radial direction of the cap.

Figure 5C:
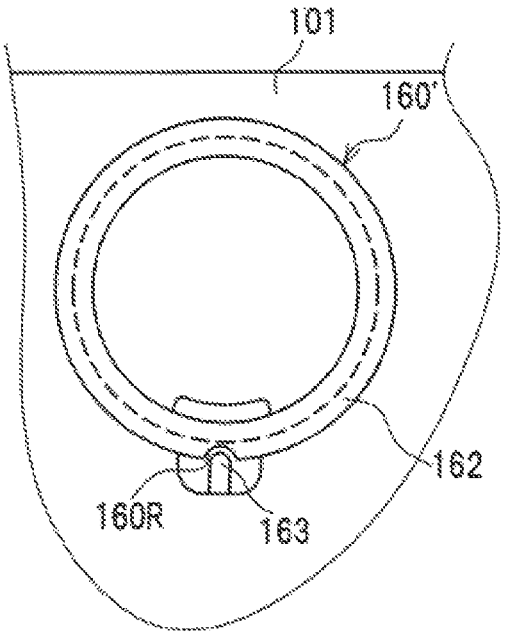

As shown in FIG. 5C, when seeing the cap 160' from the outside, a lower part (a position corresponding to the cap recess part 167) of the flange part 162 is formed with a recess part 160R. The recess part 160R is configured so that it is fitted with a protrusion 163 provided at a position corresponding to the recess part 107' at the outer side of the inner periphery surface of the cartridge frame 101, and becomes a basis for positioning in the rotating direction when mounting the cap 160'.

In the meantime, the right end portion 155R of the shaft 155 of the agitator 150 is arranged and supported between the recess part 107' and the cap recess part 167. A bottom surface 167S of the cap recess part 167, to which a side surface of the right end portion 155R of the agitator 150 is contacted, is a cylindrical surface coaxial with the outer periphery surface of the cap tube part 166, and the shaft center position of the agitator 150 is not changed in the upper-lower direction even when the attaching phase (a posture in the rotating direction) of the cap 160' slightly deviates.

In the second illustrative embodiment, the right end portion 155R (right end portion) of the shaft 155 of the agitator 150 is supported by the recess part 107' that is a part of the inner periphery surface of the cartridge frame 101 and the cap recess part 167 that is a part of the outer periphery surface of the cap 160'. Thereby, it is possible to simply mount the agitator 150 without bending the shaft 155, like the first illustrative embodiment.

In the meantime, the right end portion 155R of the shaft 155, which is partially inserted into the recess part 107', is pressed to a bottom of the recess part 107' by a reaction force applied to the film 158 of the agitator 150 from the inner wall of the toner containing unit 140. Therefore, since it is possible to insert and maintain the right end portion 155R into the recess part 107' through the side surface thereof when the cap 160' is removed, it is possible to simply perform the mounting operation.

Also, the rotary shaft of the agitator 150 is arranged between the recess part 107', which is recessed more outwards in the radial direction than (the tube part 106 of) the inner periphery surface of the toner filling port 105, and the cap recess part 167 formed on the outer periphery surface of the cap 160'. Therefore, compared to a configuration of the related art where a spoke-shaped rib dividing a filling port is provided and a rotary bearing is provided at a substantially center of the opening, it is possible to secure the wider opening in the filling port because there is no rib or bearing crossing the opening of the filling port. Therefore, it is possible to realize a configuration that does not lower the filling efficiency of the toner.

Like the configuration shown in FIG. 2C of the first illustrative embodiment, the right end portion 155R of the shaft 155 of FIG. 5B is configured so that a center (a shaft center position) of the round end portion abuts on a recess termination surface 107E' of the recess part 107'. That is, the recess termination surface 107E' configures the abutting surface restraining the rightward position of the right end portion 155R of the agitator 150.

Figure 5D:
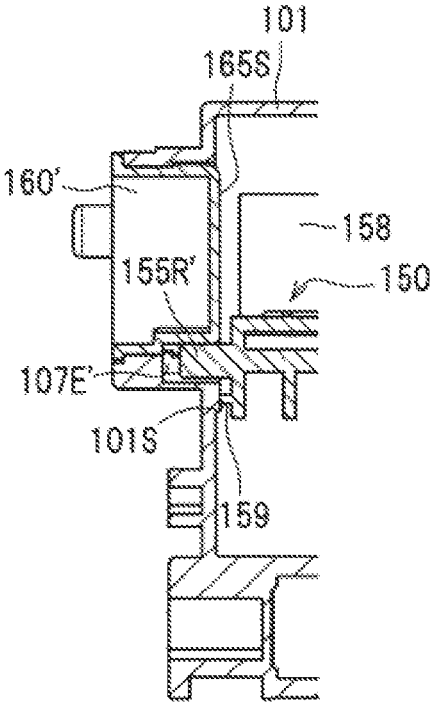

A modified embodiment of the second illustrative embodiment is shown in FIG. 5D. In the modified embodiment of FIG. 5D, the agitator 150 having the same end portion shape as the right end portion 155R' of the shaft 155 shown in FIG. 4C is adopted. The end surface of the projection 159, which is provided at the position distant outwards from the right end portion 155R' of the shaft in the radial direction by a predetermined interval, abuts on the contact surface 101S or contact surface 165S, so that the agitator 150 is positioned rightwards, which is the same as that of the modified embodiment (see FIGS. 4B and 4C) of the first illustrative embodiment.

3. Third Illustrative Embodiment

Subsequently, a third illustrative embodiment is described with reference to FIG. 6. Meanwhile, in this illustrative embodiment, the structure for supporting the right end portion 155R, 155R' of the agitator 150 described in the first and second illustrative embodiments is only partially changed. Thus, the same constitutional elements as those of the first or second illustrative embodiment are denoted with the same reference numerals and the descriptions thereof are omitted.

Figure 6A:
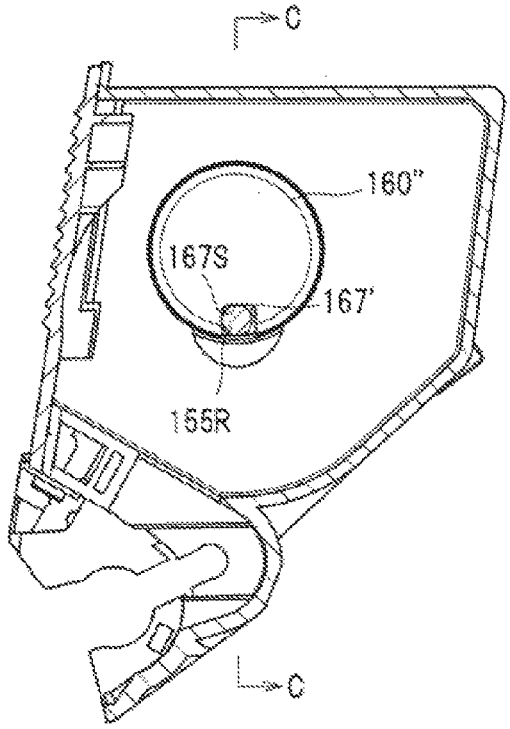
Figure 6B:
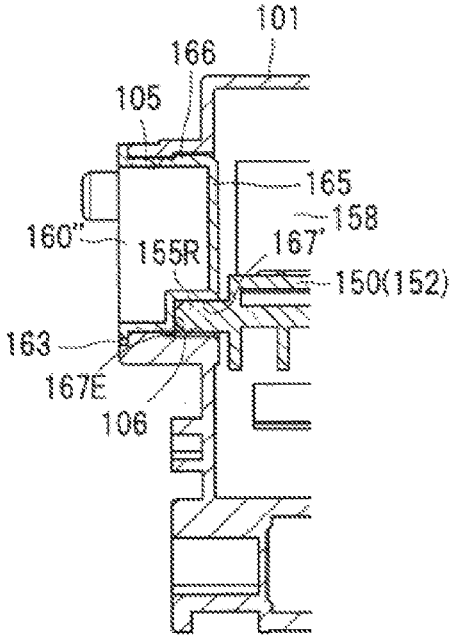

As shown in FIGS. 6A and 6B, in the third illustrative embodiment, the tubular inner periphery surface 106 defining the toner filling port 105 is not provided with the recess part. In the meantime, a part of an outer periphery surface (the cap tube part 166) of a cap 160" is formed with a cap recess part 167' that is recessed inwards in the radial direction of the cap. The cap recess part 167' is deeper than the cap recess part 167 of the second illustrative embodiment and has such a shape that the right end portion 155R of the agitator 150 is entirely inserted therein.

In the third illustrative embodiment, when the right end portion 155R of the shaft 155 of the agitator 150 is arranged on the inner periphery surface 106 of the toner filling port 105 and the cap 160" is mounted with the cap recess part 167', which is a part of the outer periphery surface of the cap, being phase-matched with the right end portion 155R of the shaft 155, the right end portion 155R of the shaft 155 is supported between the inner periphery surface 106 of the toner filling port 105 (the cartridge frame 101) and the cap recess part 167' of the cap 160".

As shown in FIG. 6B, a lower part (a position corresponding to the cap recess part 167') of the flange part 162 of the cap 160" is formed with the same recess part as the second illustrative embodiment, which is fitted with the protrusion 163 provided on the outer side of the inner periphery surface of the cartridge frame 101. Thus, when mounting the cap 160", it is possible to make the precise positioning in the rotating direction. Therefore, when mounting the cap 160", it is possible to precisely position the shaft center of the agitator 150.

Also in this illustrative embodiment, when mounting the agitator 150, it is not necessary to bend the shaft 155. The right end portion 155R is supported and is enabled to operate simultaneously with the mounting of the cap 160". Also, the right end portion 155R of the shaft 155 is configured so that it is pressed to a lower part of the inner periphery surface of the toner filling port 105 by a reaction force applied to the film 158 of the agitator 150 from the inner wall of the toner containing unit 140. Therefore, since it is possible to maintain the right end portion 155R at the lower part of the inner periphery surface of the toner filling port 105 when the cap 160" is removed, it is possible to simply perform the mounting operation.

Also, the rotary shaft of the agitator 150 is arranged between the inner periphery surface 106 of the toner filling port 105 and the cap recess part 167' formed on the outer periphery surface of the cap 160". Therefore, compared to a configuration of the related art where a spoke-shaped rib dividing a filling port is provided and a rotary bearing is provided at a substantial center of an opening, it is possible to secure the wider opening in the filling port because there is no rib or bearing crossing the opening of the filling port. Therefore, it is possible to make a configuration that does not lower the filling efficiency of the toner.

The right end portion 155R of the shaft 155 shown in FIG. 6B has the same shape as that shown in FIG. 2C of the first illustrative embodiment and that in FIG. 5B of the second illustrative embodiment. However, a center (a shaft center position) of the round end portion thereof is configured to abut on the recess termination surface 167E of the cap recess part 167'. That is, the recess termination surface 167E configures the abutting surface restraining the rightward position of the right end portion 155R of the agitator 150.

Figure 6C:
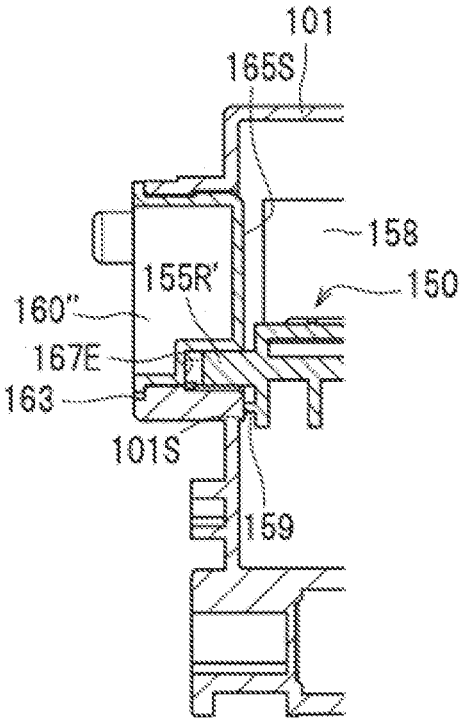

A modified embodiment of the third illustrative embodiment is shown in FIG. 6C. In the modified embodiment of FIG. 6C, the agitator 150 having the same end portion shape as the right end portion 155R' of the shaft 155 shown in FIG. 4C is adopted. The end surface of the projection 159, which is provided at the position distant outwards from the right end portion 155R' of the shaft in the radial direction by a predetermined interval, abuts on the contact surface 101S or contact surface 165S, so that the agitator 150 is positioned rightwards, which is the same as the modified embodiment (see FIGS. 4B and 4C) of the first illustrative embodiment.

4. Fourth Illustrative Embodiment

Subsequently, a fourth illustrative embodiment is described with reference to FIG. 7. Also in this illustrative embodiment, the structure for supporting the right end portion 155R, 155R' of the agitator 150 described in the first to third illustrative embodiments is only partially changed. Thus, the same constitutional elements as those of the first to third illustrative embodiments are denoted with the same reference numerals and the descriptions thereof are omitted.

Figure 7A:
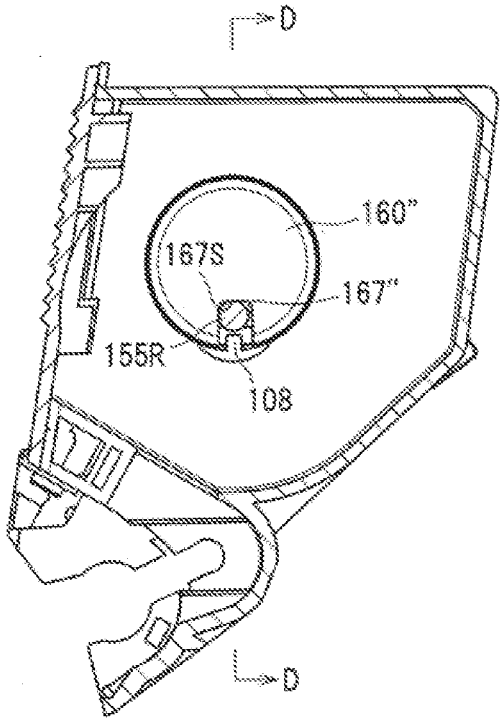
Figure 7B:
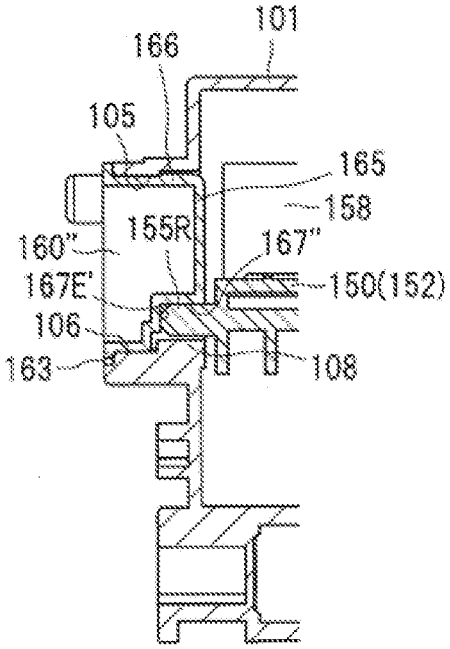

As shown in FIGS. 7A and 7B, in the fourth illustrative embodiment, at the lower part of the tubular inner periphery surface 106 defining the toner filling port 105, a protruding part 108 that protrudes inwards in the radial direction is formed from an inner edge portion (an edge portion at the toner filling port 105-side) to a substantially center in an outward direction. In the meantime, the cap 160" is formed at a part of the cap tube part 166 with a cap recess part 167" that is recessed inwards in the radial direction. The cap recess part 167" is deeper than the cap recess part 167' of the third illustrative embodiment and is designed so that the right end portion 155R of the agitator 150 is inserted between the cap recess part 167" and an end portion of the protruding part 108.

In the fourth illustrative embodiment, when the right end portion 155R of the shaft 155 of the agitator 150 is arranged at the end portion of the protruding part 108 of the toner filling port 105 and the cap 160" is mounted with the cap recess part 167", which is a part of the outer periphery surface of the cap, being phase-matched with the protruding part 108 at which the right end portion 155R of the shaft 155 is arranged, the right end portion 155R of the shaft 155 is supported between the protruding part 108 and the cap recess part 167".

As shown in FIG. 7B, a lower part (a position corresponding to the cap recess part 167") of the flange part 162 of the cap 160" is formed with the same recess part as the second illustrative embodiment, which is fitted with the protrusion 163 provided on the outer side (a position corresponding to the protruding part 108) of the inner periphery surface of the cartridge frame 101. Thus, when mounting the cap 160", it is possible to make the precise positioning in the rotating direction. Therefore, when mounting the cap 160", it is possible to precisely position the shaft center of the agitator 150.

Also in this illustrative embodiment, when mounting the agitator 150, it is not necessary to bend the shaft 155 and the right end portion 155R is supported and is enabled to operate simultaneously with the mounting of the cap 160". Also, the right end portion 155R of the shaft 155 is configured so that it is pressed to the end portion of the protruding part 108 by a reaction force applied to the film 158 of the agitator 150 from the inner wall of the toner containing unit 140. Therefore, since it is possible to maintain the right end portion 155R at the end portion of the protruding part 108 of the toner filling port 105 when the cap 160" is removed, it is possible to simply perform the mounting operation.

Also, the rotary shaft of the agitator 150 is arranged between the protruding part 108 of the toner filling port 105 and the cap recess part 167' formed on the outer periphery surface of the cap 160". Therefore, compared to a configuration of the related art where a spoke-shaped rib dividing a filling port is provided and a rotary bearing is provided at a substantial center of an opening, it is possible to secure the wider opening in the filling port because there is no rib or bearing crossing the opening of the filling port. Therefore, it is possible to make a configuration that does not lower the filling efficiency of the toner.

The right end portion 155R of the shaft 155 shown in FIG. 7B is configured so that the center of the round end portion abuts on the recess termination surface 167E of the cap recess part 167". That is, the recess termination surface 167E' configures the abutting surface restraining the rightward position of the right end portion 155R of the agitator 150.

Figure 7C:
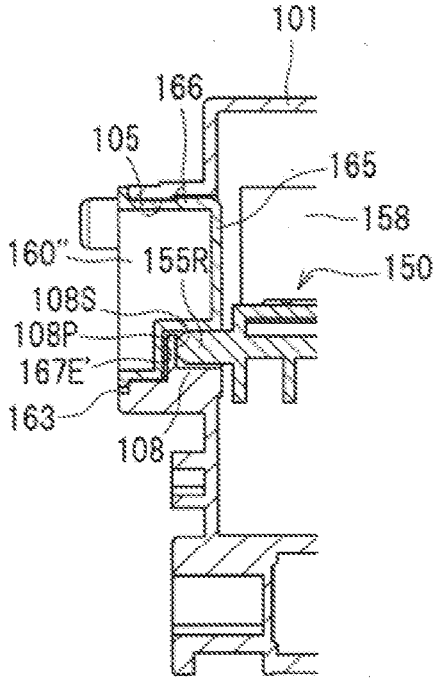
Figure 7D:
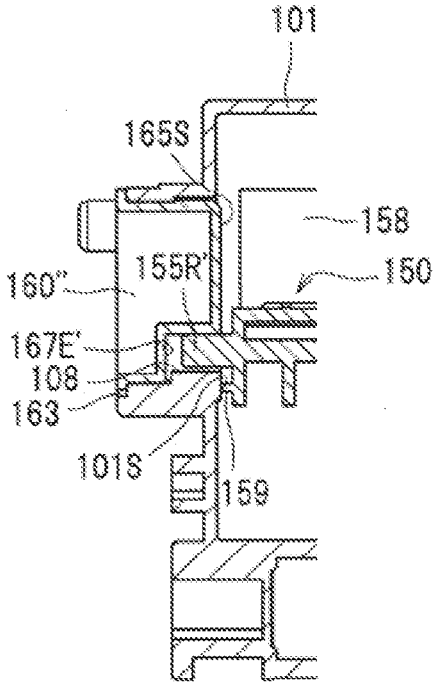

Modified embodiments of the fourth illustrative embodiment are shown in FIGS. 7C and 7D. In the modified embodiment of FIG. 7C, an outer end portion of the protruding part 108 has a plate-shaped part 108P, which further protrudes inwards in the radial direction, and covers the recess termination surface 167E'. An inner surface of the plate-shaped part 108P provides a contact surface 108S restraining the rightward position of the shaft 155. Therefore, the center of the round end portion of the right end portion 155R of the shaft 155 abuts on the contact surface 108S.

In the modified embodiment of FIG. 7D, the agitator 150 having the same end portion shape as the right end portion 155R' of the shaft 155 shown in FIG. 4C is adopted. The end surface of the projection 159, which is provided at the position distant outwards from the right end portion 155R' of the shaft in the radial direction by a predetermined interval, abuts on the contact surface 101S or contact surface 165S, so that the agitator 150 is positioned rightwards, which is the same as the modified embodiment (see FIGS. 4B and 4C) of the first illustrative embodiment.

Although the invention has been described with reference to the illustrative embodiments, the invention is not limited to the illustrative embodiments. The specific configuration can be appropriately changed without departing from the scope of the invention.

In the above illustrative embodiments, the inner surface defining the filling port for filling developer is configured as a substantially cylindrical surface. However, the shape of the inner surface is not particularly limited and may be a tube shape having an elliptical or polygonal opening and the like insomuch as it is a shape suitable for filling of the developer and sealing by the cap.

In the above illustrative embodiments, the invention is applied to the developing cartridge 100 that is mounted to the color printer 1. However, the invention is not limited thereto. For example, the invention can be applied to a developer container that is mounted to a monochrome laser printer or other image forming apparatus such as copier and complex machine, for example.

The present invention provides illustrative, non-limiting examples as follows:

(1) In a first aspect, there is provided a developer container including: a housing including an inner surface that defines a filling port for filling developer; a cap mounted to the housing and sealing the filling port; and an agitating member having a rotary shaft and configured to be rotated about the rotary shaft to agitate the developer in the housing, wherein a first end portion of the rotary shaft is supported by the inner surface of the housing and the cap mounted to the housing.

According to the first aspect, the first end portion of the rotary shaft is supported by the inner surface of the housing and the cap that is mounted to the housing. Therefore, it is possible to simply mount the agitating member without bending the rotary shaft thereof. Also, since it is possible to arrange the agitating member and a structure for supporting the agitating member at a position at which the filling port is blocked only a little, it is possible to prevent decreasing of a filling efficiency of the developer.

(2) In a second aspect, there is provided the developer container according to the first aspect, wherein the inner surface of the housing includes, a tube part, and a recess part recessed outwards with respect to the tube part, and wherein the first end portion of the rotary shaft is disposed in the recess part.

According to the second aspect, the first end portion of the rotary shaft is disposed in the recess part, which is recessed outwards with respect to the tube part, and the cap is mounted to the housing. Thus, it is possible to simply mount the agitating member without bending the rotary shaft.

(3) In a third aspect, there is provided the developer container according to the second aspect, wherein the cap includes a cap tube part having an outer surface fitted to the tube part, and wherein the first end portion of the rotary shaft is supported by the recess part of the inner surface of the housing and the outer surface of the cap tube part.

According to the third aspect, the first end portion of the rotary shaft is disposed in the recess part, which is recessed outwards with respect to the tube part, and the cap is mounted to the housing. Thus, it is possible to simply mount the agitating member without bending the rotary shaft. Also, the cap tube part of the outer surface of the cap is fitted to the tube part of the inner surface of the housing, so that the filling port can be securely sealed.

(4) In a fourth aspect, there is provided the developer container according to the second aspect, wherein the cap includes, a cap tube part having an outer surface fitted to the tube part, and a cap recess part recessed inwards with respect to the cap tube part, and wherein the first end portion of the rotary shaft is supported by the recess part of the inner surface of the housing and the cap recess part of the cap.

According to the fourth aspect, the first end portion of the rotary shaft is inserted into the recess part, which is recessed outwards with respect to the tube part, and the cap is mounted to the housing. Thus, it is possible to simply mount the agitating member without bending the rotary shaft. Also, the cap tube part of the outer surface of the cap is fitted to the tube part of the inner surface of the housing, so that the filling port can be securely sealed.

(5) In a fifth aspect, there is provided the developer container according to the third aspect, wherein a distance between edge portions of the recess part, which define a boundary between the tube part and the recess part, is smaller than an outer diameter of the rotary shaft.

According to the fifth aspect, when the first end portion of the rotary shaft of the agitating member is inserted into the recess part of the inner surface of the housing, the first end portion of the rotary shaft is temporarily fixed just by lightly pushing the first end portion into between the edge portions of the recess part narrower than the outer diameter of the rotary shaft. Therefore, handling is remarkably easy when inserting the first end portion of the rotary shaft into the recess part of the inner surface of the housing without bending the agitating member and then mounting the cap to the housing.

It is not necessary for the inner surface of the housing to include the recess part.

(6) For example, in the sixth aspect, there is provided the developer container according to the first aspect, wherein the inner surface includes, a tube part, and a protruding part protruding inwards with respect to the tube part, wherein the cap includes, a cap tube part having an outer surface fitted to the tube part, and a cap recess part recessed inwards with respect to the cap tube part and receiving the protruding part, and wherein the first end portion of the rotary shaft is supported by the protruding part of the inner surface of the housing and the cap recess part of the cap.

According to the sixth aspect, the cap is mounted with the cap recess part being positioned with the first end portion of the rotary shaft of the agitating member arranged at an end portion of the protruding part in the filling port. Thus, it is possible to simply mount the agitating member without bending the rotary shaft. Also, the cap tube part of the outer surface of the cap is fitted to the tube part of the inner surface of the housing, so that the filling port can be securely sealed.

(7) In a seventh aspect, there is provided the developer container according to any one of the first to sixth aspects, wherein the cap includes a seal part abutting on the inner surface of the housing to suppress the developer from leaking, and wherein the first end portion of the rotary shaft is located at a more downstream side than the seal part in a mounting direction of the cap.

According to the seventh aspect, it is possible to securely seal the filling port at the outer side of the first end portion of the rotary shaft of the agitating member, which is supported by the inner surface of the housing and the cap.

(8) In an eighth aspect, there is provided the developer container according to any one of the first to seventh aspects, wherein the housing further includes an abutting surface facing inwards in a direction of the rotary shaft, and wherein the first end portion of the rotary shaft is positioned in the direction of the rotary shaft by the abutting surface of the housing.

(9) In a ninth aspect, there is provided the developer container according to any one of the first to eighth aspects, wherein the cap further includes an abutting surface facing inwards in a direction of the rotary shaft, and wherein the first end portion of the rotary shaft is positioned in the direction of the rotary shaft by the abutting surface of the cap.

According to the eighth and ninth aspects, it is possible to perform the positioning securely and easily when mounting the agitating member.

(10) In a tenth aspect, there is provided the developer container according to any one of the first to ninth aspects, wherein the agitating member includes, a support part protruding outwards from the rotary shaft in a radial direction of the rotary shaft, and a film supported by the support part, and wherein a size of the support part in the radial direction is smaller than a size of the filling port in the radial direction.

According to the tenth aspect, it is possible to insert and mount the agitating member into the housing through the filling port. Therefore, it is possible to easily mount the agitating member.

(11) In an eleventh aspect, there is provided the developer container according to the first aspect, wherein the cap includes, a cap tube part having an outer surface fitted to the inner surface of the housing, and a cap recess part recessed inwards with respect to the cap tube part, and wherein the first end portion of the rotary shaft is supported by the inner surface of the housing and the cap recess part of the cap.

According to the eleventh aspect, the first end portion of the rotary shaft is inserted into the cap recess part, which is recessed inwards with respect to the cap tube part, and the cap is mounted to the housing. Thus, it is possible to simply mount the agitating member without bending the rotary shaft. Also, the cap tube part of the outer surface of the cap is fitted to the inner surface of the housing, so that the filling port can be securely sealed.

What is claimed is:

1. A developer container comprising:

a housing including an inner surface that defines a filling port for filling developer;

a cap mounted to the housing and sealing the filling port; and an agitating member having a rotary shaft and configured to be rotated about the rotary shaft to agitate the developer in the housing, wherein a first end portion of the rotary shaft is supported by the inner surface of the housing and the cap mounted to the housing, wherein the housing further includes an abutting surface facing inwardly in a direction of the rotary shaft, and wherein the first end portion of the rotary shaft is positioned in the direction of the rotary shaft by the abutting surface of the housing.

2. The developer container according to claim 1, wherein the inner surface of the housing includes:

a tube part, and a recess part recessed outwardly with respect to the tube part, and wherein the first end portion of the rotary shaft is disposed in the recess part.

3. The developer container according to claim 2,
wherein the cap includes a cap tube part having an outer surface fitted to the tube part, and
wherein the first end portion of the rotary shaft is supported by the recess part of the inner surface of the housing and the outer surface of the cap tube part.

4. The developer container according to claim 3,
wherein a distance between edge portions of the recess part, which define a boundary between the tube part and the recess part, is smaller than an outer diameter of the rotary shaft.

5. The developer container according to claim 2,
wherein the cap includes:
a cap tube part having an outer surface fitted to the tube part, and
a cap recess part recessed inwardly with respect to the cap tube part, and
wherein the first end portion of the rotary shaft is supported by the recess part of the inner surface of the housing and the cap recess part of the cap.

6. The developer container according to claim 1,
wherein the inner surface includes:
a tube part, and
a protruding part protruding inwardly with respect to the tube part,
wherein the cap includes:
a cap tube part having an outer surface fitted to the tube part, and
a cap recess part recessed inwardly with respect to the cap tube part and receiving the protruding part, and
wherein the first end portion of the rotary shaft is supported by the protruding part of the inner surface of the housing and the cap recess part of the cap.

7. The developer container according to claim 1,
wherein the cap includes a seal part abutting on the inner surface of the housing to suppress the developer from leaking, and
wherein the first end portion of the rotary shaft is located at a more downstream side than the seal part in a mounting direction of the cap.

8. The developer container according to claim 1,
wherein the cap further includes an abutting surface facing inwardly in a direction of the rotary shaft, and
wherein the first end portion of the rotary shaft is positioned in the direction of the rotary shaft by the abutting surface of the cap.

9. The developer container according to claim 1,
wherein the agitating member includes:
a support part protruding outwardly from the rotary shaft in a radial direction of the rotary shaft, and
a film supported by the support part, and
wherein a size of the support part in the radial direction is smaller than a size of the filling port in the radial direction.

10. The developer container according to claim 1,
wherein the cap includes:
a cap tube part having an outer surface fitted to the inner surface of the housing, and
a cap recess part recessed inwardly with respect to the cap tube part, and
wherein the first end portion of the rotary shaft is supported by the inner surface of the housing and the cap recess part of the cap.

11. A developer container comprising:
a housing including an inner surface that defines a filling port for filling developer;
a cap mounted to the housing and sealing the filling port; and
an agitating member having a rotary shaft and configured to be rotated about the rotary shaft to agitate the developer in the housing,
wherein a first end portion of the rotary shaft is supported by the inner surface of the housing and the cap mounted to the housing,
wherein the cap further includes an abutting surface facing inwards in a direction of the rotary shaft, and
wherein the first end portion of the rotary shaft is positioned in the direction of the rotary shaft by the abutting surface of the cap.

12. The developer container according to claim 11,
wherein the inner surface of the housing includes:
a tube part, and
a recess part recessed outwardly with respect to the tube part, and
wherein the first end portion of the rotary shaft is disposed in the recess part.

13. The developer container according to claim 12,
wherein the cap includes a cap tube part having an outer surface fitted to the tube part, and
wherein the first end portion of the rotary shaft is supported by the recess part of the inner surface of the housing and the outer surface of the cap tube part.

14. The developer container according to claim 13,
wherein a distance between edge portions of the recess part, which define a boundary between the tube part and the recess part, is smaller than an outer diameter of the rotary shaft.

15. The developer container according to claim 12,
wherein the cap includes:
a cap tube part having an outer surface fitted to the tube part, and
a cap recess part recessed inwardly with respect to the cap tube part, and
wherein the first end portion of the rotary shaft is supported by the recess part of the inner surface of the housing and the cap recess part of the cap.

16. The developer container according to claim 11,
wherein the inner surface includes:
a tube part, and
a protruding part protruding inwardly with respect to the tube part,
wherein the cap includes:
a cap tube part having an outer surface fitted to the tube part, and
a cap recess part recessed inwardly with respect to the cap tube part and receiving the protruding part, and
wherein the first end portion of the rotary shaft is supported by the protruding part of the inner surface of the housing and the cap recess part of the cap.

17. The developer container according to claim 11,
wherein the cap includes a seal part abutting on the inner surface of the housing to suppress the developer from leaking, and
wherein the first end portion of the rotary shaft is located at a more downstream side than the seal part in a mounting direction of the cap.

18. The developer container according to claim 11,
wherein the agitating member includes:
a support part protruding outwardly from the rotary shaft in a radial direction of the rotary shaft, and
a film supported by the support part, and wherein a size of the support part in the radial direction is smaller than a size of the filling port in the radial direction.

19. The developer container according to claim 11, wherein the cap includes:

a cap tube part having an outer surface fitted to the inner surface of the housing, and a cap recess part recessed inwardly with respect to the cap tube part, and wherein the first end portion of the rotary shaft is supported by the inner surface of the housing and the cap recess part of the cap.

20. A developer container comprising:

a housing including an inner surface that defines a filling port for filling developer;

a cap mounted to the housing and sealing the filling port; and an agitating member having a rotary shaft and configured to be rotated about the rotary shaft to agitate the developer in the housing, wherein a first end portion of the rotary shaft is supported by the inner surface of the housing and an outer surface of the cap mounted to the housing.

* * * * *